US006972084B1

(12) United States Patent
Nakashima et al.

(10) Patent No.: US 6,972,084 B1
(45) Date of Patent: Dec. 6, 2005

(54) FUEL OIL COMPOSITION FOR DIESEL ENGINE

(75) Inventors: Isao Nakashima, Ohi-machi (JP); Noriaki Oomori, Ohi-machi (JP); Kazuyuki Murakami, Okayama (JP); Takashi Hino, Kawasaki (JP)

(73) Assignee: TonenGeneral Sekiyu K.K., Saitama (JP)

( * ) Notice: Subject to any disclaimer, the term of this patent is extended or adjusted under 35 U.S.C. 154(b) by 0 days.

(21) Appl. No.: 10/019,411

(22) PCT Filed: Dec. 25, 1999

(86) PCT No.: PCT/JP99/03434

§ 371 (c)(1),
(2), (4) Date: Jul. 22, 2002

(87) PCT Pub. No.: WO01/00754

PCT Pub. Date: Jan. 4, 2001

(51) Int. Cl.[7] ..... C10L 1/08; C10L 1/18
(52) U.S. Cl. ..... 208/15; 44/393; 585/14
(58) Field of Search ..... 208/15; 585/14

(56) References Cited

U.S. PATENT DOCUMENTS 5,389,111 A * 2/1995 Nikanjam et al. ..... 44/300
5,389,112 A * 2/1995 Nikanjam et al. ..... 44/300
6,136,049 A * 10/2000 Nakajima et al. ..... 44/393
6,136,050 A * 10/2000 Nakajima et al. ..... 44/393
6,150,575 A * 11/2000 Angevine et al. ..... 585/14
6,265,629 B1 * 7/2001 Fava et al. ..... 585/14
6,776,897 B2 * 8/2004 Bacha et al. ..... 208/14

FOREIGN PATENT DOCUMENTS

WO WO01/00754 A1 1/2001

* cited by examiner

*Primary Examiner*—Ellen M. McAvoy
(74) *Attorney, Agent, or Firm*—Joseph J. Allocca

(57) ABSTRACT

It is an object of the present invention to provide a fuel oil composition for diesel engines showing good CFPP and lubricity, efficiently controlling PM emissions and containing sulfur at 0.05 wt. % or less. The present invention provides a fuel oil composition for diesel engines comprising a base stock which has normal paraffin compounds having a carbon number of 20 or more at 4.0 wt. % or less, specific carbon number distribution in the high-boiling normal paraffin compounds and polynuclear aromatic hydrocarbon compounds at 8.0 vol. % or less, contains sulfur at 0.05 wt. % or less, and is incorporated with 0.01 to 0.1 wt. % (as the active component) of an FI and 0.002 to 0.1 wt. % (as the active component) of a lubricity improver.

7 Claims, No Drawings

FUEL OIL COMPOSITION FOR DIESEL ENGINE

FIELD OF THE INVENTION

This invention relates to a new fuel oil composition for diesel engines, more particularly the composition characterized by base stock which contains a specific content of normal paraffin compounds having a carbon number of 20 or more, has a specific carbon number distribution in the high-boiling normal paraffin compounds, contains a specific content of polynuclear aromatic hydrocarbon compounds and sulfur at 0.05 wt. % or less, and is incorporated with a flow improver and lubricity improver.

BACKGROUND OF THE INVENTION

Diesel engines are widely used for various purposes, e.g., for driving automobiles, ships and construction machines, and are still spreading further. As a result, fuel for diesel engines is increasingly in demand, and becoming heavier to satisfy the increased demands, because straight-run diesel fuel oil is distilled deeper and/or blended with heavier fractions. This is accompanied by several problems, e.g., deteriorated fluidity at low temperature (i.e., increased pour point and/or cold flow plugging point). It is anticipated, therefore, that several engine troubles, e.g., clogging of fuel passage or fuel filter, may occur in a normal temperature range at which the engine is operated in some districts. The other concerns are increased nitrogen oxide and particulate matter emissions, which further aggravate environmental pollution.

Several measures against deteriorated fluidity of diesel fuel oils at low temperature have been proposed to provide fuel oils having adequate pour point and cold flow plugging point (CFPP) properties for temperature conditions, in particular in cold districts. These measures include limitation on end point of straight-run diesel oil, limitation on use of heavier fractions as the blending stocks, use of lighter blending stocks, and use of adequate additives, e.g., fluidity improver, including pour point depressant and flow improver (FI), to improve fluidity at low temperature. For example, Japanese Laid-open Patent Application No. 8-157839 discloses fuel oil composition characterized by base stock which contains normal paraffin compounds at 15 wt. % or less, normal paraffin compounds having a carbon number of 20 or more at 1.2 wt % or less, and sulfur at 0.15 wt. % or less, as the composition serviceable in cold districts, high in density, sufficiently low in pour point and allowing the engine to produce a high power.

Japanese Laid-open Patent Application No. 7-331261 discloses a diesel fuel oil composition composed of diesel oil having an end point in a range from 320 to 340° C., incorporated with 0.1 to 2.0 vol. % of a fraction containing normal paraffin compounds having a carbon number of 26 to 31 and 100 to 600 ppm of an ethylene vinyl acetate-based additive to improve fluidity at low temperature. This composition is aimed at abatement of particulate emissions from a diesel engine and improvement of low-temperature fluidity, measured by CFPP.

Limitation on end point of straight-run diesel oil and limitation on use of heavier fractions as the blending stocks to secure low-temperature fluidity of diesel fuel oils provide a good pour point, but are difficult to provide a good CFPP. Moreover, these approaches little contribute to increasing diesel fuel oil supplies. Blending diesel fuel oil with a lighter fraction decreases flash point and also decreases engine output. Use of an additive, such as pour point depressant or FI, involves some problems. For example, a pour point depressant, although decreasing pour point, will not decrease CFPP. An FI, on the other hand, although generally decreasing pour point and CFPP, may not efficiently decrease CFPP, depending on type of stock for base stock which constitutes diesel fuel oil or distillation properties of base stock.

The techniques to abate emissions, e.g., nitrogen oxides and particulate matter, from diesel engines have been also developed from various angles. These include improvement of combustion chamber shapes, installation of exhaust gas recycle (EGR) systems, exhaust gas cleaning-up catalytic converters and particulate matter collectors, and improvement of diesel fuel oils and lubricants. None of these, however, brings satisfactory results in terms of abatement effect, economic efficiency or stability for extended periods. An EGR system, which is considered to be one of efficient means, recycles part of exhaust gases into the combustion air stream. However, this approach causes various problems, e.g., decreased durability and reliability of the engine, deterioration of the lubricant, increased particulate matter emissions and decreased engine output, because exhaust gases contain sulfate ions and particulate matter. These problems will be further aggravated, when an EGR system is installed for a direct injection diesel engine which is required to operate under a high load. Sulfate ions are derived from sulfur contained in diesel fuel oil, and low-sulfur diesel fuel oil containing sulfur at 0.05 wt. % or less has now become a social need.

Sulfur contained in a diesel fuel oil can be reduced by refining, in particular catalytic hydrogenation, of the base stock. This, however, is accompanied by decreased lubricity of diesel fuel oil itself, and will damage the injection device of the engine. It is known that wear of the injection pump notably increases as sulfur content decreases from 0.2 wt. %.

Improving fuel oil quality has been attracting attention as an effective means to abate pollutant emissions, because it needs essentially no engine modification. For example, Japanese Laid-open Patent Application No. 8-225789 discloses diesel fuel which contains sulfur at 0.05 wt. % or less, benzothiophene at 30 wt.ppm or more as sulfur, and polynuclear aromatic hydrocarbon compounds having 3 rings or more at 0.2 to 1.4 wt. %, and this diesel fuel further containing indoles at 13 wt.ppm or less as nitrogen. It is claimed that these fuel oils satisfy the environmental requirement for low sulfur content and exhibit sufficient lubricity without using an additive, e.g., friction modifier.

Japanese Laid-open Patent Application No. 8-291292 discloses a diesel fuel oil composition which contains sulfur at 0.01 to 0.05 wt. %, and (A) an ester of a nitrogen compound having hydroxide group and straight-chain saturated fatty acid, and (B) 15 to 2000 mg/L of at least one type of polymer selected from the group consisting of the polymers from monomers of olefin compounds, ethylenic unsaturated alkyl carboxylates and saturated aliphatic vinyl compounds. It is claimed that this composition exhibits good lubricity in spite of very low sulfur content, improved low-temperature fluidity and no deterioration of exhaust gases without causing troubles at the fuel injection pump in the diesel engine.

These prior-art techniques, however, give diesel fuel oils insufficient in low-temperature fluidity, abatement of pollutant emissions and lubricity, and are also economically unsatisfactory. Therefore, they can rarely give diesel fuel oil compositions showing good CFPP and lubricity, while efficiently controlling pollutant emissions (in particular, particulate matter) and containing sulfur at 0.05 wt. % or less.

It is an object of the present invention to provide a diesel fuel oil composition efficiently controlling pollutant emissions, showing good CFPP and lubricity, and containing sulfur at 0.05 wt. % or less by improving the prior-art techniques.

SUMMARY OF THE INVENTION

The applicants of the present invention have extensively studied the effects of normal paraffin content, carbon number distribution of the normal paraffin compounds and polynuclear aromatic hydrocarbon compound content on low-temperature fluidity and lubricity of the diesel fuel oil incorporated with an FI and lubricity improver and also on quantity of particulate matter (PM) emissions exhausted when it is combusted, for diesel fuel base stock containing sulfur at 0.05 wt. % or less, to find that PM emissions are greatly reduced and good CFPP and lubricity can be secured when the base stock containing sulfur at 0.05 wt. % or less satisfies the relationships of $0<A\leqq4.00$ (wherein, A is content (wt. %), based on total normal paraffin compounds present in the base stock, of normal paraffin compounds having a carbon number of 20 or more), $0.04\leqq[B/C]\leqq0.40$ (wherein, B is content (wt. %) of normal paraffin compounds having a carbon number of (n+5), C is content (wt. %) of normal paraffin compounds having a carbon number of (n); [B/C] is average B/C ratio; and (n) is a positive integer when total content of normal paraffin compounds having a carbon number of (n) or more is 3.0 wt. % or less and closest thereto, based on the total normal paraffin compounds in the base stock), and $0<D\leqq8.0$ (wherein, D is content (vol. %), based on the whole base stock, of polynuclear aromatic hydrocarbon compounds), and is incorporated with 0.01 to 0.10 wt. % (as the active component) of an FI and 0.002 to 0.1 wt. % (as the active component) of a lubricity improver, reaching the present invention.

That is, the present invention provides a diesel fuel oil composition characterized by base stock satisfying the relationships $0<A\leqq4.00$ (wt. %), $0.04\leqq[B/C]\leqq0.40$ and $0<D\leqq8.0$ (vol. %), containing sulfur at 0.05 wt. % or less, and being incorporated with 0.01 to 0.10 wt. % of an FI and 0.002 to 0.1 wt. % of a lubricity improver.

The present invention, relating to the above diesel fuel oil composition, includes the following preferred embodiments:

(1) the diesel fuel oil composition composed of a base stock having a [B/C] ratio of 0.07 to 0.20, (2) the diesel fuel oil composition composed of a base stock having a D value of 0 to 5.0 vol. %, (3) the diesel fuel oil composition of (1), wherein said base stock has a D value of 0 to 5.0 vol. %, (4) the diesel fuel oil composition of (1), wherein active ingredient of the FI is at least one type of compounds selected from the group consisting of ethylene glycol ester-based compounds and ethylene-vinyl acetate-based copolymers, (5) the diesel fuel oil composition of one of (1) to (3), wherein active ingredient of the FI is at least one type of compounds selected from the group consisting of ethylene glycol ester-based compounds and ethylene-vinyl acetate-based copolymers, (6) the diesel fuel oil composition, wherein content of the active component for the FI is 0.03 to 0.07 wt. %, (7) the diesel fuel oil composition of one of (1) to (5), wherein content of the active component for the FI is 0.03 to 0.07 wt. %, (8) the diesel fuel oil composition, wherein the active component for the lubricity improver is an ester-based compound, (9) the diesel fuel oil composition of one of (1) to (7), wherein the active component for the lubricity improver is an ester-based compound,

(10) the diesel fuel oil composition, wherein content of the active component for the lubricity improver is 0.005 to 0.05 wt. %, and

(11) the diesel fuel oil composition of one of (1) to (9), wherein content of the active component for the lubricity improver is 0.005 to 0.05 wt. %.

The present invention provides a fuel oil composition for diesel engines which efficiently controls PM emissions and exhibits good CFPP and lubricity by incorporating a base stock satisfying the relationships $0<A\leqq4.00$ (wt. %), $0.04\leqq[B/C]\leqq0.40$ and $0<D\leqq8.0$ and containing sulfur at 0.05 wt. % or less with an adequate FI and lubricity improver.

DETAILED DESCRIPTION OF THE INVENTION

The present invention is described below in detail. The diesel fuel oil composition of the present invention is characterized by base stock which has the component A, [B/C] ratio and component D in specific ranges, contains sulfur at 0.05 wt. % or less, and is incorporated with 0.01 to 0.10 wt. % of an FI and 0.002 to 0.1 wt. % of a lubricity improver.

The base stock for the present invention mainly comprises a mineral oil, having a flash point of 40° C. or higher and 90% distillation temperature of 360° C. or lower. The mineral oil for the present invention is a petroleum fraction, including a petroleum fraction obtained by atmospheric distillation of crude oil, and petroleum fraction obtained by atmospheric or vacuum distillation of crude oil and refined by an adequate process, e.g., hydrogenation, hydrocracking, catalytic cracking and a combination thereof. These petroleum fractions can be used individually or in combination. The base stock component other than petroleum fraction includes vegetable oil, e.g., soybean, coconut and rape oil, and animal oil, e.g., whale and fish oil.

The diesel fuel oil composition of the present invention is composed of a base stock which satisfies the relationship $0<A\leqq4.00$ (wt. %) (wherein, A is content, based on all normal paraffin compounds present in the base stock, of normal paraffin compounds having a carbon number of 20 or more). When A is above 4.00 wt. %, the normal paraffin compounds may separate out as ambient temperature decreases, to cause problems, e.g., clogging of the fuel passage or fuel filter in the diesel engine.

The diesel fuel oil composition of the present invention is also composed of a base stock which satisfies the relationship $0.04\leqq[B/C]\leqq0.40$, preferably $0.07\leqq[B/C]\leqq0.20$ (wherein, B is content (wt. %) of normal paraffin compounds having a carbon number of (n+5), C is content (wt. %) of normal paraffin compounds having a carbon number of (n), [B/C] is average B/C ratio, and (n) is a positive integer when total content of normal paraffin compounds having a carbon number of (n) or more is 3.0 wt. % or less and closest thereto, based on the total normal paraffin compounds in the base stock. Assuming that the component A in the base stock accounts for 3.0 wt. % of the total normal paraffin components of the base stock, the average of the $(n\text{-}C_{25})/(n\text{-}C_{20})$, $(n\text{-}C_{26})/(n\text{-}C_{21})$, $(n\text{-}C_{27})/(n\text{-}C_{22})$ . . . ratios consecutively calculated is in a range from 0.04 to 0.40, inclusive. When [B/C] is below 0.04, some of the normal paraffin compounds in the base stock may separate out as large planar crystals as ambient temperature decreases, even when the relationship $0<A\leqq 4.00$ (wt. %) is satisfied, to easily cause plugging of the fuel filter. In other words, such a base stock has an excessively high CFPP. The similar troubles will occur, when [B/C] exceeds 0.40.

The diesel fuel oil composition of the present invention is also composed of a base stock which satisfies the relationship $0<D-\leqq 8.0$ (vol. %), preferably $0<D\leqq 5.0$, more preferably $0<D\leqq 3.0$ (wherein, D is content (vol. %), based on the whole base stock, of polynuclear aromatic hydrocarbon compounds). When D exceeds 8.0 vol. %, PM content in the exhaust gases may increase to an unacceptable level. Normally, a base stock contains aromatic hydrocarbon compounds at 20 to 40 vol. %; single-ring aromatic hydrocarbon compounds at 12 to 30 vol. % and polynuclear aromatic hydrocarbon compounds (having two or more rings) at 2 to 15 vol. %.

Therefore, the fuel oil composition of the present invention for diesel engines shows a good CFPP, even when ambient temperature decreases, when its base stock satisfies the relationships $0<A\leqq=4.00$ (wt. %), $0.04\leqq[B/C]\leqq 0.40$ and $0<D\leqq 8.0$ (vol. %).

The component A of the base stock for the present invention can be selected from adequate petroleum fractions of different normal paraffin content. These petroleum fractions include petroleum fractions obtained by atmospheric distillation of crude of varying normal paraffin content, and petroleum fractions obtained by atmospheric or vacuum distillation of crude and refined by an adequate process, e.g., solvent dewaxing and catalytic dewaxing. [B/C] of the base stock can be adjusted by controlling extent of rectification for the distillation operation. [B/C] increases as extent of rectification decreases, and so is vice versa. The component D of the base stock can be adjusted by adequately blending petroleum fractions of varying polynuclear aromatic hydrocarbon content or petroleum fractions whose polynuclear aromatic hydrocarbon content is adjusted by an adequate process, e.g., solvent extraction or hydrogenation. Content of polynuclear aromatic hydrocarbon compounds can be determined by the method proposed by Japanese Petroleum Institute (JPI-5S-49-97, based on HPLC). The above petroleum fractions can be used individually or in combination to adjust A, [B/C] and D levels for the base stock for the present invention.

The FI useful for the present invention can be selected from the known ones. These include ethylene glycol ester-based compounds, ethylene-vinyl acetate copolymers, ethylene alkylacrylate-based copolymers, chlorinated polyethylene, polyalkyl acrylate, alkenyl succinamide-based compounds. The preferable ones are an ethylene glycol ester-based compound and/or ethylene-vinyl acetate copolymer. An FI dosage below 0.01 wt. % may not satisfactorily decrease CFPP, and above 0.1 wt. % is not economical, because CFPP will not decrease as much as increased dosage. The preferable FI dosage is 0.03 to 0.07 wt. %. The above FI's may be used individually or in combination.

The lubricity improver useful for the present invention can be selected from the known ones. These include a fatty acid, e.g., stearic, linolic and oleic acid, and ester, e.g., those of the above fatty acid and polyalcohol, e.g., glycerin. The preferable one is an ester. A lubricity improver dosage below 0.002 wt. % may not satisfactorily improve lubricity, and above 0.1 wt. % is not economical, because lubricity will not be improved as much as increased dosage. The preferable lubricity improver dosage is 0.005 to 0.05 wt. %. The above lubricity improvers may be used individually or in combination.

The fuel oil composition of the present invention for diesel engines may be incorporated with other known additives for fuel oil, so long as its performance is not damaged. These additives include cetane improver, antioxidant, metal deactivator, detergent, corrosion inhibitor, pour point depressant, de-icer, bactericide, combustion promoter, antistatic agent, and coloring agent. A general dosage of the additive is 0.1 to 0.5 wt. % in the case of pour point depressant, although not limited to this level. One or more of these additives may be used for the present invention, as required.

The diesel fuel oil composition of the present invention may be also incorporated with one or more types of oxygenated compounds so long as its performance is not damaged. These compounds include aliphatic alcohols, e.g., methanol, ethanol, isopropanol, n-butanol, isobutanol, tert-butanol, amyl alcohol, isoamyl alcohol, n-octanol, 2-ethyl hexanol, n-heptyl alcohol, tridecyl alcohol, cyclohexanol and methyl cyclohexanol; ethers, e.g., methyl tert-butyl ether and ethyl tert-butyl ether; dialkyl phthalates, e.g., diethyl phthalate, dipropyl phthalate and dibutyl phthalate; glycol-ether compounds, e.g., ethylene glycol monoisobutyl ether, diethylene glycol mono-n-butyl ether, diethylene glycol monoisobutyl ether, diethylene glycol dimethyl ether, triethylene glycol mono-n-butyl ether, triethylene glycol dimethyl ether, propylene glycol monomethyl ether acetate and dipropylene glycol mono-n-butyl ether; hydroxylamine compounds; and diketones, e.g., acetyl acetone. A general dosage of the oxygenated compound is 1 to 15 wt. %, although not limited to this level.

The present invention is described in more detail by EXAMPLES, below, which by no means limit the present invention. The following base stocks, FI's and lubricity improver were used for EXAMPLES and COMPARATIVE EXAMPLES. Measurements of CFPP, A, [B/C] and D are also described.

(1) Base Stock

A total of 19 types of base stocks (A to S) were used. Their properties are given in Tables 1 and 3.

TABLE 1

| | Base stock | | | | | | | |
|---|---|---|---|---|---|---|---|---|
| | A | B | C | D | E | F | G | H |
| Density(g/cm³) | 0.8369 | 0.8338 | 0.8248 | 0.8461 | 0.8390 | 0.8457 | 0.8370 | 0.8365 |
| Flash point(° C.) | 70 | 68 | 69 | 69 | 71 | 75 | 73 | 75 |
| Distillation (° C.) | | | | | | | | |
| Initial boiling point | 176.0 | 182.0 | 161.5 | 224.0 | 186.0 | 215.0 | 208.0 | 216.0 |
| 10% | 222.5 | 220.5 | 212.5 | 260.0 | 233.5 | 257.0 | 248.0 | 254.0 |
| 50% | 287.5 | 279.0 | 279.0 | 294.0 | 281.5 | 292.0 | 287.0 | 287.0 |
| 90% | 346.0 | 345.0 | 342.5 | 340.0 | 345.0 | 336.0 | 334.0 | 330.0 |
| End point | 376.5 | 377.0 | 374.0 | 365.0 | 378.0 | 357.0 | 357.0 | 353.0 |

TABLE 1-continued

| | Base stock | | | | | | | |
|---|---|---|---|---|---|---|---|---|
| | A | B | C | D | E | F | G | H |
| Sulfur content* | 0.04 | 0.05 | 0.03 | 0.04 | 0.03 | 0.04 | 0.04 | 0.03 |
| Cloud point(° C.) | −4 | −3 | −4 | −2 | 1 | 0 | 1 | 1 |
| CFPP(° C.) | −5 | −4 | −4 | −3 | 0 | −2 | 0 | −2 |
| Pour point(° C.) | −7.5 | −5 | −7.5 | −2.5 | 0 | −2.5 | 0 | 0 |
| A(wt %) | 2.78 | 3.03 | 2.82 | 3.05 | 4.52 | 3.30 | 3.45 | 3.80 |
| [B/C] | 0.092 | 0.089 | 0.089 | 0.054 | 0.027 | 0.035 | 0.434 | 0.045 |
| D(vol %) | 3.7 | 2.7 | 4.7 | 7.8 | 4.8 | 4.9 | 4.0 | 4.5 |

*wt %

TABLE 2

| | Base stock | | | | | | | |
|---|---|---|---|---|---|---|---|---|
| | I | J | K | L | M | N | O | P |
| Density(g/cm$^3$) | 0.8365 | 0.8377 | 0.8350 | 0.8369 | 0.8403 | 0.8425 | 0.8139 | 0.8255 |
| Flash point(° C.) | 72 | 70 | 68 | 69 | 69 | 71 | 75 | 7 |
| Distillation(° C.) | | | | | | | | |
| Initial boiling point | 205.0 | 171.0 | 175.0 | 172.0 | 146.5 | 139.0 | 194.5 | 167.0 |
| 10% | 245.0 | 230.5 | 228.5 | 230.0 | 218.0 | 222.0 | 225.5 | 228.0 |
| 50% | 285.0 | 280.0 | 278.5 | 279.5 | 276.0 | 280.0 | 265.5 | 273.0 |
| 90% | 348.0 | 343.0 | 345.5 | 344.0 | 334.0 | 334.5 | 312.0 | 324.0 |
| End point | 379.0 | 372.0 | 376.0 | 373.0 | 361.5 | 361.0 | 329.0 | 346.0 |
| Sulfur content* | 0.03 | 0.03 | 0.03 | 0.03 | 0.03 | 0.03 | 0.02 | 0.02 |
| Cloud point(° C.) | 2 | −2 | −2 | −2 | −1 | −1 | −5 | −4 |
| CFPP(° C.) | 1 | −3 | −3 | −3 | −3 | −3 | −6 | −5 |
| Pour point(° C.) | 0 | −5 | −5 | −5 | −5 | −5 | −7.5 | −5 |
| A(wt %) | 3.30 | 1.06 | 0.92 | 1.02 | 3.61 | 3.92 | 0.90 | 1.57 |
| [B/C] | 0.050 | 0.354 | 0.154 | 0.248 | 0.086 | 0.100 | 0 | 0 |
| D(vol %) | 10.2 | 3.2 | 2.3 | 4.5 | 5.3 | 7.5 | 2.1 | 3.8 |

*wt %

TABLE 3

| | Base stock | | |
|---|---|---|---|
| | Q | R | S |
| Density (g/cm$^3$) | 0.8355 | 0.8348 | 0.8355 |
| Flash point (° C.) | 75 | 72 | 73 |
| Distillation (° C.) | | | |
| Initial boiling point | 170.0 | 172.5 | 170.5 |
| 10% | 230.0 | 232.5 | 230.5 |
| 50% | 280.0 | 281.5 | 282.0 |
| 90% | 346.0 | 350.0 | 351.0 |
| End point | 376.0 | 375.0 | 377.0 |
| Sulfur content* | 0.03 | 0.03 | 0.03 |
| Cloud point (° C.) | −1 | 0 | 0 |
| CFPP (° C.) | −2 | −2 | −1 |
| Pour point (° C.) | −2.5 | −2.5 | −2.5 |
| A (wt %) | 3.35 | 4.72 | 3.85 |
| [B/C] | 0.460 | 0.320 | 0.350 |
| D (vol %) | 5.1 | 7.8 | 10.5 |

*wt %

(2) FI's

An ethylene glycol ester-based FI (ECA9911 produced by EXXON Chemical) and ethylene-vinyl acetate-based FI (PF240, produced by EXXON Chemical) were used.

(3) Lubricity Improver

A lubricity improver with ester-based compound as the active ingredient (PDN655, produced by EXXON Chemical) was used.

(4) Measurement of CFPP

CFPP was measured as per JIS K-2288.

(5) Measurement of "A"

Content of an individual normal paraffin compound in each base stock was measured by gas chromatography using an analyzer (GC-6AM, produced by Shimadzu), where each sample was passed through a capillary column (inner diameter: 0.25 mm, length: 15m, impregnated with methyl silicon to a thickness of 0.1 $\mu$m) at 50 to 350° C. "A" is defined as total content of normal paraffin compounds having a carbon number of 20 or more.

(6) Measurement of [B/C]

[B/C] was determined by the following procedure. Content of an individual normal paraffin compound in each base stock was measured by gas chromatography. Content of the normal paraffin compound having the largest carbon number, and contents of the normal paraffin compounds having smaller carbon numbers are calculated consecutively, where (n) is defined as the number of carbon when total content of normal paraffin compounds having a carbon number of (n) or more is 3.0 wt. % or less and closest thereto, based on the total normal paraffin compounds in the base stock. Next, (content of normal paraffin compounds having a carbon number of (n+5))/(content of normal paraffin compounds having a carbon number of (n)) ratios are calculated consecutively, and the average is taken as [B/C]. The same gas chromatography as that for measurement of "A" was used.

(7) Measurement of "D"

Content of polynuclear aromatic hydrocarbon compounds were determined by the method proposed by Japanese Petroleum Institute (JPI-5S-49-97, based on HPLC). "D" was defined as total content of polynuclear aromatic hydrocarbon compounds having 2 rings and those having 3 rings or more.

EXAMPLES and COMPARATIVE EXAMPLES

The base stocks shown in Tables 1 to 3 were used to prepare the fuel oil compositions shown in Tables 4 to 7, to measure CFPP levels and lubricity of these compositions (prepared by EXAMPLES 1 to 9 and COMPARATIVE EXAMPLES 1 to 13), and quantities of PM emissions exhausted when they were combusted. The results are given in Tables 4 to 7. Methods to determine lubricity and PM emissions are described later.

TABLE 4

| | EXAMPLES | | | |
|---|---|---|---|---|
| | 1 | 2 | 3 | 4 |
| Fuel oil compositions (wt %) | | | | |
| Base stock A | 99.95 | | | |
| Base stock B | | 99.95 | | |
| Base stock C | | | 99.948 | |
| Base stock D | | | | 99.95 |
| FI (ECA 9911) | 0.04 | 0.04 | 0.04 | 0.04 |
| FI (PF 240) | — | — | — | — |
| Lubricity improver | 0.010 | 0.010 | 0.012 | 0.010 |
| Properties of base fuel | | | | |
| Sulfur content (wt %) | 0.04 | 0.05 | 0.03 | 0.04 |
| A (wt %) | 2.78 | 3.03 | 2.82 | 3.05 |
| [B/C] | 0.092 | 0.089 | 0.089 | 0.054 |
| D (vol %) | 3.7 | 2.7 | 4.7 | 7.8 |
| CFPP (° C.) of fuel oil | | | | |
| (a)Fuel oil (incorporated with no FI) | −5 | −4 | −4 | −3 |
| (b)Fuel oil (incorporated with an FI) | −16 | −13 | −14 | −9 |
| (c)Decreased CFPP [(a) − (b)] | 11 | 9 | 10 | 6 |
| Lubricity of fuel oil | | | | |
| Size of wear-caused scar (μm) | 416 | 411 | 418 | 421 |
| PM emissions in exhaust gases | | | | |
| PM (g/km) | 0.076 | 0.060 | 0.083 | 0.110 |

TABLE 5

| | EXAMPLES | | | | |
|---|---|---|---|---|---|
| | 5 | 6 | 7 | 8 | 9 |
| Fuel oil compositions (wt %) | | | | | |
| Base stock J | 99.97 | | | | |
| Base stock K | | 99.97 | | | |
| Base stock L | | | 99.97 | | |
| Base stock M | | | | 99.968 | |
| Base stock N | | | | | 99.97 |
| FI (ECA 9911) | — | — | — | — | — |
| FI (PF 240) | 0.02 | 0.02 | 0.02 | 0.02 | 0.02 |
| Lubricity improver | 0.01 | 0.01 | 0.01 | 0.012 | 0.01 |
| Properties of base fuel | | | | | |
| Sulfur content (wt %) | 0.03 | 0.03 | 0.03 | 0.03 | 0.03 |
| A (wt %) | 1.06 | 0.92 | 1.02 | 3.61 | 3.92 |
| [B/C] | 0.354 | 0.154 | 0.248 | 0.086 | 0.100 |
| D (vol %) | 3.2 | 2.3 | 4.5 | 5.3 | 7.5 |
| CFPP (° C.) of fuel oil | | | | | |
| (a)Fuel oil (incorporated with no FI) | −3 | −3 | −3 | −3 | −3 |
| (b)Fuel oil (incorporated with an FI) | −12 | −12 | −12 | −11 | −9 |
| (c)Decreased CFPP [(a) − (b)] | 9 | 9 | 9 | 8 | 6 |
| Lubricity of fuel oil | | | | | |
| Size of wear-caused scar (μm) | 410 | 408 | 415 | 421 | 416 |
| PM emissions in exhaust gases | | | | | |
| PM (g/km) | 0.072 | 0.061 | 0.085 | 0.09 | 0.12 |

TABLE 6

| | COMPARATIVE EXAMPLES | | | | | |
|---|---|---|---|---|---|---|
| | 1 | 2 | 3 | 4 | 5 | 6 |
| Fuel oil compositions (wt %) | | | | | | |
| Base stock A | | | | | 99.96 | |
| Base stock E | 99.91 | | | | | |
| Base stock F | | 99.90 | | | | |
| Base stock G | | | 99.953 | | | |
| Base stock H | | | | 99.92 | | |
| Base stock I | | | | | | 99.95 |
| FI (ECA 9911) | 0.04 | 0.04 | 0.04 | — | 0.04 | 0.04 |
| FI (PF 240) | — | — | — | — | — | — |
| Lubricity improver | 0.05 | 0.06 | 0.007 | 0.08 | — | 0.01 |
| Properties of base fuel | | | | | | |
| Sulfur content (wt %) | 0.03 | 0.04 | 0.04 | 0.03 | 0.04 | 0.03 |
| A (wt %) | 4.52 | 3.30 | 3.45 | 3.80 | 2.78 | 3.30 |
| [B/C] | 0.027 | 0.035 | 0.434 | 0.045 | 0.092 | 0.050 |
| D (vol %) | 4.8 | 4.9 | 4.0 | 4.5 | 3.7 | 10.2 |

TABLE 6-continued

| | COMPARATIVE EXAMPLES | | | | | |
|---|---|---|---|---|---|---|
| | 1 | 2 | 3 | 4 | 5 | 6 |
| CFPP (° C.) of fuel oil | | | | | | |
| (a)Fuel oil (incorporated with no FI) | 0 | −2 | 0 | −2 | −5 | −3 |
| (b)Fuel oil (incorporated with an FI) | −1 | −3 | 0 | −2 | −15 | −10 |
| (c)Decreased CFPP [(a) − (b)] | 1 | 1 | 0 | 0 | 10 | 7 |
| Lubricity of fuel oil | | | | | | |
| Size of wear-caused scar (μm) | 403 | 410 | 406 | 418 | 580 | 415 |
| PM emissions in exhaust gases | | | | | | |
| PM (g/km) | 0.088 | 0.086 | 0.080 | 0.082 | 0.070 | 0.250 |

TABLE 7

| | COMPARATIVE EXAMPLES | | | | | | |
|---|---|---|---|---|---|---|---|
| | 7 | 8 | 9 | 10 | 11 | 12 | 13 |
| Fuel oil compositions(wt %) | | | | | | | |
| Base stock J | 99.99 | 99.98 | | | | | |
| Base stock O | | | 99.90 | | | | |
| Base stock P | | | | 99.968 | | | |
| Base stock Q | | | | | 99.973 | | |
| Base stock R | | | | | | 99.93 | |
| Base stock S | | | | | | | 99.97 |
| FI(ECA 9911) | — | — | — | — | — | — | — |
| FI(PF 240) | — | 0.02 | 0.02 | 0.02 | 0.02 | 0.02 | 0.02 |
| Lubricity improver | 0.01 | — | 0.08 | 0.012 | 0.007 | 0.05 | 0.01 |
| Properties of base fuel | | | | | | | |
| Sulfur content(wt %) | 0.03 | 0.03 | 0.02 | 0.02 | 0.03 | 0.03 | 0.03 |
| A(wt %) | 1.06 | 1.06 | 0.90 | 1.57 | 3.35 | 4.72 | 3.85 |
| [B/C] | 0.354 | 0.354 | 0 | 0 | 0.460 | 0.320 | 0.350 |
| D(vol %) | 3.2 | 3.2 | 2.1 | 3.8 | 5.1 | 7.8 | 10.5 |
| CFPP (° C.) of fuel oil | | | | | | | |
| (a) Fuel oil (incorporated with no FI) | −3 | −3 | −6 | −5 | −2 | −2 | −1 |
| (b) Fuel oil (incorporated with an FI) | −4 | −12 | −7 | −6 | −3 | −3 | −9 |
| (c)Decreased CFPP [(a)−(b)] | 1 | 9 | 1 | 1 | 1 | 1 | 8 |
| Lubricity of fuel oil | | | | | | | |
| Size of wear-caused scar (μm) | 425 | 552 | 401 | 418 | 428 | 406 | 401 |
| PM emissions in exhaust gases PM (g/km) | 0.071 | 0.075 | 0.062 | 0.078 | 0.09 | 0.11 | 0.28 |

(1) Measurement of Lubricity

Lubricity was assessed by resistance of fuel oil to wear. Resistance to wear was measured as per JPI-55-50-97 (gas oil/lubricant oil testing method). Size of the wear-caused scar (μm) was determined using a high frequency reciprocating rig (HFRR, produced by PCS) under the conditions shown in Table 8. Size of the scar increases as lubricity of fuel oil decreases.

TABLE 8

| | |
|---|---|
| Liquid quantity | 2 ± 0.20 ml |
| Stroke | 1 ± 0.03 mm |
| Frequency | 50 ± 1 Hz |
| Liquid temperature | 40 ± 2° C. or 60 ± 2° C. |
| Load | 200 ± 1 gf |
| Testing time | 75 ± 0.1 min |
| Liquid surface area | 6 ± 1 $cm^2$ |

(2) Measurement of PM Emissions

PM emissions in the exhaust gases were determined as per the "diesel vehicle 10–15 mode exhaust gas testing method (TRIAS-24-4-1993).

(a) Test Engine and Conditions

The test engine and conditions are given in Tables 9 and 10.

TABLE 9

| | |
|---|---|
| Engine type | IDI (Toyota Corolla) |
| Inner cylinder diameter and stroke (mm) | 86.0 × 85.0 |
| Number of cylinders | 4 |
| Total displacement | 1974 |
| Compression ratio | 23 |
| Max. Output (PS/rpm) | 73/4700 |

TABLE 10

| | |
|---|---|
| Fuel oil temperature (° C.), | 25.0 |
| Outlet temperature of cooling water (° C.), | 80 |
| Lubricant temperature (° C.), | 90 |
| Intake air temperature (° C.), | 25 ± 2 |
| Intake air humidity (RH %) | 50 ± 5 |

(b) Collection and Measurement of PM

The exhaust gases were directed from the exhaust pipe to a dilution tunnel system (Horiba Seisakusho), to measure PM emissions (g/km).

As shown in Tables 4 and 5, the fuel oil composition exhibits a notably low CFPP of −9 to −16° C., when it comprises a base stock which has the component A, [B/C] ratio and component D in specific ranges, contains sulfur at 0.05 wt. % or less, and is incorporated with an adequate FI and lubricity improver. Its CFPP is significantly lower than that of the base stock by 6 to 11° C. It notably controls PM emissions. It also has high resistance to wear, showing a wear-caused scar of 408 to 421 μm. By contrast, the compositions prepared by COMPARATIVE EXAMPLES shown in Tables 6 and 7, which fail to satisfy the relationship with respect to A or [B/C], has a CFPP value high and virtually unchanged from that of the base stock, even when incorporated with an FI and lubricity improver (COMPARATIVE EXAMPLES 1 to 3 and 9 to 12). It is also found that a fuel oil composition shows insufficient CFPP, essentially on a level with that of the base stock, in the absence of Fl, even when its base stock has the component A, [B/C] ratio and component D in specific ranges (COMPARATIVE EXAMPLES 4 and 7). Similarly, a fuel oil composition shows notably low lubricity in the absence of lubricity improver, even when its base stock has the component A, [B/C] ratio and component D in specific ranges (COMPARATIVE EXAMPLES 5 and 8). Moreover, a fuel oil composition gives, when combusted, a notably large quantity of PM emissions, when its base stock has the component D out of the specific range, even when it has the component A and [B/C] ratio in specific ranges, and is incorporated with FI and lubricity improver. It is therefore essential for a fuel oil composition for diesel engines to comprise a base stock which has the component A, [B/C] ratio and component D in specific ranges, contains sulfur at 0.05 wt. % or less, and is incorporated with an adequate FI and lubricity improver, in order to efficiently control PM emissions and exhibit good CFPP and lubricity.

What is claimed is:

1. A fuel oil composition for diesel engines comprising a base stock which satisfies the following relationships (1), (2) and (3), contains sulfur at 0.05 wt. % or less, and is incorporated with 0.01 to 0.10 wt. % of a flow improver and 0.002 to 0.1 wt. % of a lubricity improver:

$$(a)\ 0<A\leqq 4.0 \quad (1)$$

wherein, A is content (wt. %), based on the total normal paraffin compounds present in the base stock, of normal paraffin compounds having a carbon number of 20 or more, $$(b)\ 0.04\leqq [B/C]\leqq 0.40 \quad (2)$$

wherein, B is content (wt. %) of normal paraffin compounds having a carbon number of (n+5), C is content (wt. %) of normal paraffin compounds having a carbon number of (n), [B/C] is average B/C ratio, and (n) is a positive integer when total content of normal paraffin compounds having a carbon number of (n) or more is 3.0 wt. % or less and closest thereto, based on the total normal paraffin compounds in the base stock, and $$(c)\ 0<D\leqq 8.0 \quad (3)$$

wherein, D is content (vol. %), based on the whole base stock, of polynuclear aromatic hydrocarbon compounds.

2. The fuel oil composition of claim 1 wherein the [B/C] ratio is 0.07 to 0.20.

3. The fuel oil composition of claim 1 wherein the value of D is 0 to 5.0 vol %.

4. The fuel oil composition of claim 1 wherein the flow improver content, based on active component, is 0.03 to 0.07 wt %.

5. The fuel oil composition of claim 1 wherein the lubricity improver content, based on active component, is 0.005 to 0.05 wt %.

6. The fuel oil composition of claim 1, 2, 3, 4 or 5 wherein the active ingredient of the flow improver is at least one type of compound selected from the group consisting of ethylene glycol ester-based compounds and ethylene-vinyl acetate-based copolymers.

7. The fuel oil composition of claim 1, 2, 3, 4 or 5 wherein the lubricity improver is at ester-based compound.

* * * * *